US007950339B2

(12) United States Patent
Shuman et al.

(10) Patent No.: US 7,950,339 B2
(45) Date of Patent: May 31, 2011

(54) PYROLYSIS APPARATUS WITH TRANSVERSE OXYGENATION

(75) Inventors: Bruce Shuman, Huntington Beach, CA (US); Jerry Moffatt, Huntington Beach, CA (US); Bruce Atwell, Mission Viejo, CA (US); Robert J. Romacly, Huntington Beach, CA (US); Glenn A. Romacly, Apple Valley, CA (US)

(73) Assignee: Rainbow Conversion Technologies, LLC, Huntington Beach, CA (US)

( * ) Notice: Subject to any disclaimer, the term of this patent is extended or adjusted under 35 U.S.C. 154(b) by 376 days.

(21) Appl. No.: 12/209,455

(22) Filed: Sep. 12, 2008

(65) Prior Publication Data

US 2009/0294270 A1 Dec. 3, 2009

Related U.S. Application Data

(63) Continuation-in-part of application No. 12/128,330, filed on May 28, 2008, now Pat. No. 7,802,528.

(51) Int. Cl.

| | |
|---|---|
| ***F23G 5/027*** | (2006.01) |
| ***F23G 5/033*** | (2006.01) |
| ***F23M 9/00*** | (2006.01) |

(52) U.S. Cl. ..... 110/229; 110/322; 110/222

(58) Field of Classification Search ..... 110/229, 110/230, 225, 297, 322; 048/119, 120, 121, 048/122, 123; 202/120, 124

See application file for complete search history.

(56) References Cited

U.S. PATENT DOCUMENTS

| | | | | |
|---|---|---|---|---|
| 3,670,668 A * | 6/1972 | Phillips | ..... | 110/212 |
| 5,389,117 A * | 2/1995 | Firey | ..... | 110/229 |
| 7,798,077 B2 * | 9/2010 | Gehring et al. | ..... | 110/229 |

* cited by examiner

*Primary Examiner* — Kenneth B Rinehart
*Assistant Examiner* — David J Laux
(74) *Attorney, Agent, or Firm* — Walter A. Hackler

(57) ABSTRACT

Apparatus for the pyrolysis of solid waste material includes a thermal reactor including an elongate hollow housing with a reaction chamber disposed within the housing. The thermal reactor is vertically oriented in order to cause solid waste material fed thereinto to pass through said reaction chamber by the force of gravity and a plurality of vanes are disposed for both conducting heat into said reactor chamber and for tumbling said solid waste material as said solid waste material passes through said reaction chamber. Inlets and outlets are provided for passing oxygen transversely through the reaction chamber.

9 Claims, 6 Drawing Sheets

78
80
80
74
90
86
88
106
70
96
70
94
112
64
60
72
72
67
68
$O_2$
110
16
54
58
7
7
100
26
32
34
26
62
38
40
50
114
46
44
69
75
115
116
118
120
122
128
124

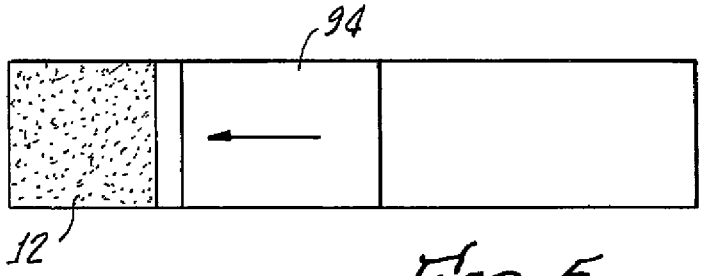
FIG. 5.
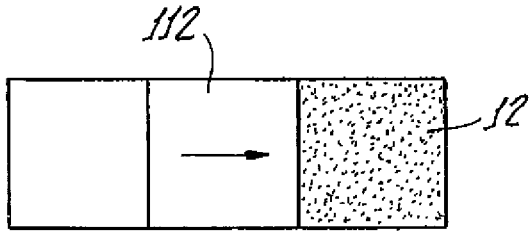
FIG. 6.
FIG. 7.
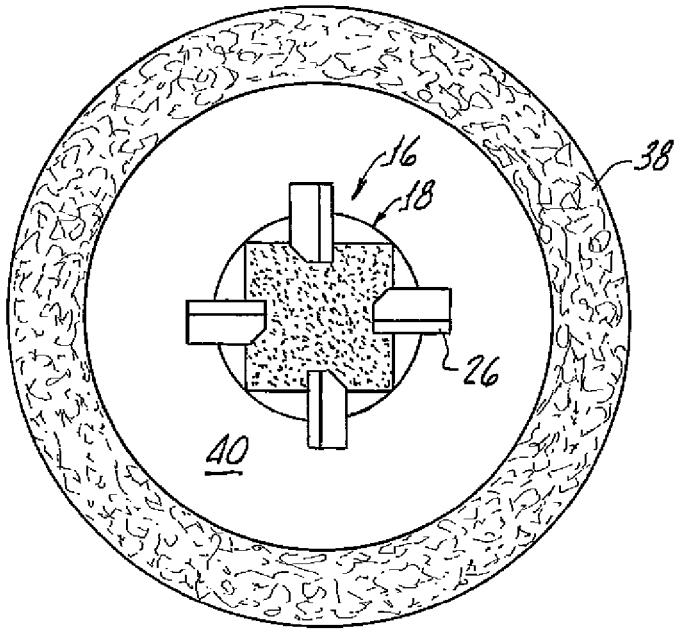

PYROLYSIS APPARATUS WITH TRANSVERSE OXYGENATION

This application is a continuation-in-part of U.S. Ser. No. 12/128,330 filed May 28, 2008 now U.S. Pat. No. 7,802,528. This reference is to be incorporated herewith in its entirety.

The present invention generally relates to solid waste treatment systems and more particularly, the invention is directed to solid waste treatment systems in which waste is processed via a thermal reaction chamber.

Disposal of solid waste materials is a serious concern. Waste represents hazards to the environment in terms of not only the space it occupies but also the deleterious effects it has on the environment. The increasing volume of waste and the dangerous conditions it may create has forced more attention to be paid to ways of dealing with the material.

In general, solid waste materials from community and from various types of industrial facilities vary widely in composition, and may include, for instance, garbage, plastic scraps, tires, and other articles of rubber, scrap wood, oil-impregnated rags, and refuse oils, all of which are organic, as well as concrete debris and scrap metal. Consequently, it has been necessary to use a variety of types of disposal facilities for handling each type of material.

It has not been possible to treat all of these types of materials by ordinary combustion methods because offensive odors are generated as a result of imperfect combustion, the production of components which are extremely corrosive, particularly at high temperature, and the presence of substantial amounts of imperfectly combusted components in the residual ash.

Moreover, provision must be made for preventing corrosion and damage to the combustion equipment and instruments and to preventing pollution of the environment such as is caused by the gases resulting from the combustion of chlorinated organic materials.

Conventionally, in the course of incineration, gasification is carried out by injecting air and steam prior to incineration. The objective is to convert organic materials from different sources into forms, which will burn uniformly in the manner of coal, wood, or charcoal; however, refuse varies so widely in properties that the reaction velocity of gasification also varies strongly. Consequently, the difficulty in effecting complete combustion without harm to the environment has been such as to make the incineration operation uneconomical in most situations.

A common method of waste disposal is the landfill method of disposal. However, because of the very large volume of waste that is generated on a daily basis, particularly in high populated areas, acceptable landfill sites are rapidly reaching capacity and new sites have become difficult to find. Accordingly, alternate methods of waste disposal, such as pyrolytic destruction of waste, have been actively considered.

With pyrolytic decomposition, many types of waste materials can be converted into energy rich fuels as combustable gases and char, or fuel carbon. Accordingly, several types of devices for pyrolyzing refuse and other waste products have been suggested. Many of these devices have proved unworkable or economically unfeasible. Others, while feasible in concept have been proven to be inefficient and unreliable in continuous operation. Still others, while attractive in theory, have been shown to be too expensive to manufacture, install and operate.

The pyrolytic process employs high temperature in, most desirably, an atmosphere substantially free of oxygen (for example, in a practical vacuum), to convert the solid organic components of waste to other states of matter, such pyrosylates in a liquid or vapor phase. The solid residue remaining after pyrolysis commonly is referred to as char, but this material may contain some inorganic components, such as metals, as well as carbon components, depending on the nature of the starting waste material. The vaporized product of pyrolysis further can be treated by a process promoting oxidation, which "cleans" the vapors to eliminate oils and other particulate matter therefrom, allowing the resultant gases then to be safely released to the atmosphere.

A typical waste treatment system utilizing pyrolysis includes an input structure for introducing the waste; a chamber or retort from which air can be purged and in which pyrolysis processing occurs; and means for raising the temperature inside the chamber.

Systems that rely upon pyrolysis often are designed with principal attention being given to system efficiency. For example, to encourage consistent results from the pyrolytic conversion process, various methods and apparatuses commonly are used to pre-treat the waste before it is introduced into the pyrolytic chamber. These include pre-sorting or separating the waste into constituents on the basis of weight, shredding the material to make it of relatively uniform size and perhaps blending it with other pre-sorted material to promote even distribution of the waste as it is introduced into the retort. Several techniques have been employed to reduce the level of moisture in the waste before introducing it into the machine, because the presence of moisture makes the pyrolytic process less efficient. Such techniques include drying by desiccation or through the application of microwave energy.

Other features often are provided to continuously move waste through the treatment unit while the system is being operated, such as a form of conveyance arrangement. Screw conveyors or conveyor belts oriented at an incline have been used to ramp waste material, in units of a defined volume and at a defined rate of flow, up from a storage bin or pre-treatment assembly at the ground level to a charging hopper at the top of the treatment unit through which waste is metered into the pyrolytic chamber. Screw conveyors, auger screws and worm conveyors all have been used to impel waste through the retort while pyrolysis takes place, again, to encourage predictable results from the process. Unfortunately, such conveyor devices are difficult to maintain.

The manner in which the retort chamber is supplied with heat energy to sustain pyrolysis also can affect the efficiency with which the process can be carried out. Uniform application of heat to the outer wall of the retort, through which it is conducted into the interior of the chamber, reduces the risk that the retort will buckle from uneven distribution of high temperatures and tends to encourage a more even distribution of heat and consistency of temperature throughout the chamber, which leads to consistent processing results. System features provided to address even heating have included those directed to the manner in which the primary source of heat energy, commonly fuel gases, being combusted in a heating chamber, is arranged with relation to the retort, and the number and placement of fuel gas injection ports, etc.

It further has been known to provide a feature which encourages the efficient use of heat to sustain the pyrolytic process, such as one that allows the recycling of gases that have once been combusted to supply heat energy to the pyrolytic chamber back through the gas injection port, where the gases can be ignited again with a fresh supply of oxygen or air.

Efficiency-promoting elements also can be provided for the processing and recycling of off-gases or vapor pyrosylate. For example, it is known that if a pressure gradient is maintained between the retort and the gas processing arrangement in the direction of the exhaust, the vapor pyrosylate naturally will tend to flow into the cleaning elements. To avoid wasting energy, the cleaned high temperature gases can be used to provide energy to some sort of generating station, such as to heat water in a boiler that supplies a steam generator.

What has long been needed and heretofore has been unavailable is an improved pyrolytic waste treatment system that is highly efficient, is easy to maintain, is safe, reliable and capable of operation with a wide variety of compositions of waste materials, is easy to maintain and one that can be constructed and installed at relatively low cost without the use of conventional conveyor apparatus.

SUMMARY OF THE INVENTION

Apparatus in accordance with the present invention for the pyrolysis of solid waste material generally includes a vertically oriented thermal reactor which includes an elongate hollow housing with a reaction chamber disposed therein.

At least one inlet and one outlet is provided for passing oxygen transversely through the reactor chamber. Preferably, a plurality of spaced apart inlets and outlet may be utilized.

The thermal reactor is vertically oriented in order to cause solid waste or material fed thereinto to pass through the reaction chamber by the force of gravity. A plurality of vanes are provided and disposed transverse to the housing and extend both exterior and interior to a housing wall for both conducting heat into the reaction chamber and for tumbling the solid waste material as the solid waste material passes through the reaction chamber.

More particularly, the vane portions have an arcuate shape and are oriented with a convex surface for contacting passing waste material and a concave surface, opposite the convex surface, for introducing voids into the passing waste material. In this manner, sufficient heat is transferred to the waste material in a uniform manner. Each one of the inlets and outlets may be fixed to a corresponding vane and the inlets and outlets are open to the reaction chamber adjacent the convex surfaces of the vanes.

A shell is provided which surrounds a thermal reactor to provide a heating chamber around the thermal reactor with burners disposed adjacent a bottom end of the thermal reactor The heating chamber is in communication with a steam boiler and a sin gas plenum is provided and disposed in the heating chamber which interconnects the top of the thermal reactor with the burners for delivering sin gas, generated in the thermal reactor, to the burners. Excess sin gas may be as an energy source.

The vanes exterior to the housing extend into the heating chamber and function to swirl heating gases from the burner as the gases rise through the heating chamber. As hereinafter described in greater detail, an inlet to the sin gas plenum may be provided to introduce oxygen.

A feed mechanism is provided for introducing the solid waste material into the top end of the thermal reactor. More particularly, the feed mechanism may include a vertically oriented solid waste receiving duct with the receiving duct including a pair of spaced apart air lock valves. The air lock valves provide a means for isolating the feed mechanism and thermal reactor from the environment.

More particularly, the feed mechanism may include a vertically oriented input duct which is in communication with the thermal reactor top and a gathering ram is provided for transversely moving discrete quantities of the solid waste material from the receiving duct to the input duct.

Still more particularly, the feed mechanism may include a packer ram for moving the solid waste material disposed in the input duct toward the reactor top and a pinch ram is provided for compressing solid waste matter proximate the thermal reactor top for enabling the solid waste matter to drop by the force of gravity into the thermal reactor. In addition, a piston ram carried by the packer ram may be provided for forcing the solid waste into the thermal reactor. The piston ram has a smaller dimensions than an inside dimension of the input duct in order to relieve pressure on the input duct Preferably, the receiving duct and input ducts are of square cross section and the thermal reactor is a round cross section of a larger diameter than the dimensions of the input duct. A transition between the square input duct and the round thermal reactor is provided which further enables free fall of the waste material introduced into the thermal reactor out by the feed mechanism.

In addition, an auger mechanism disposed at the thermal reactor bottom is provided for removing char from the thermal reactor.

BRIEF DESCRIPTION OF THE DRAWINGS

The advantages and features of the present invention will be better understood by the following description when considered in conjunction with the accompanying drawings, in which:

FIG. 5 is a cross sectional view taken along the line 5-5 of FIG. 2;

FIG. 6 is a cross sectional view taken along the line 6-6 of FIG. 3;

FIG. 7 is a cross sectional view taken along the line 7-7 of FIG. 4;

DETAILED DESCRIPTION

Figure 1:
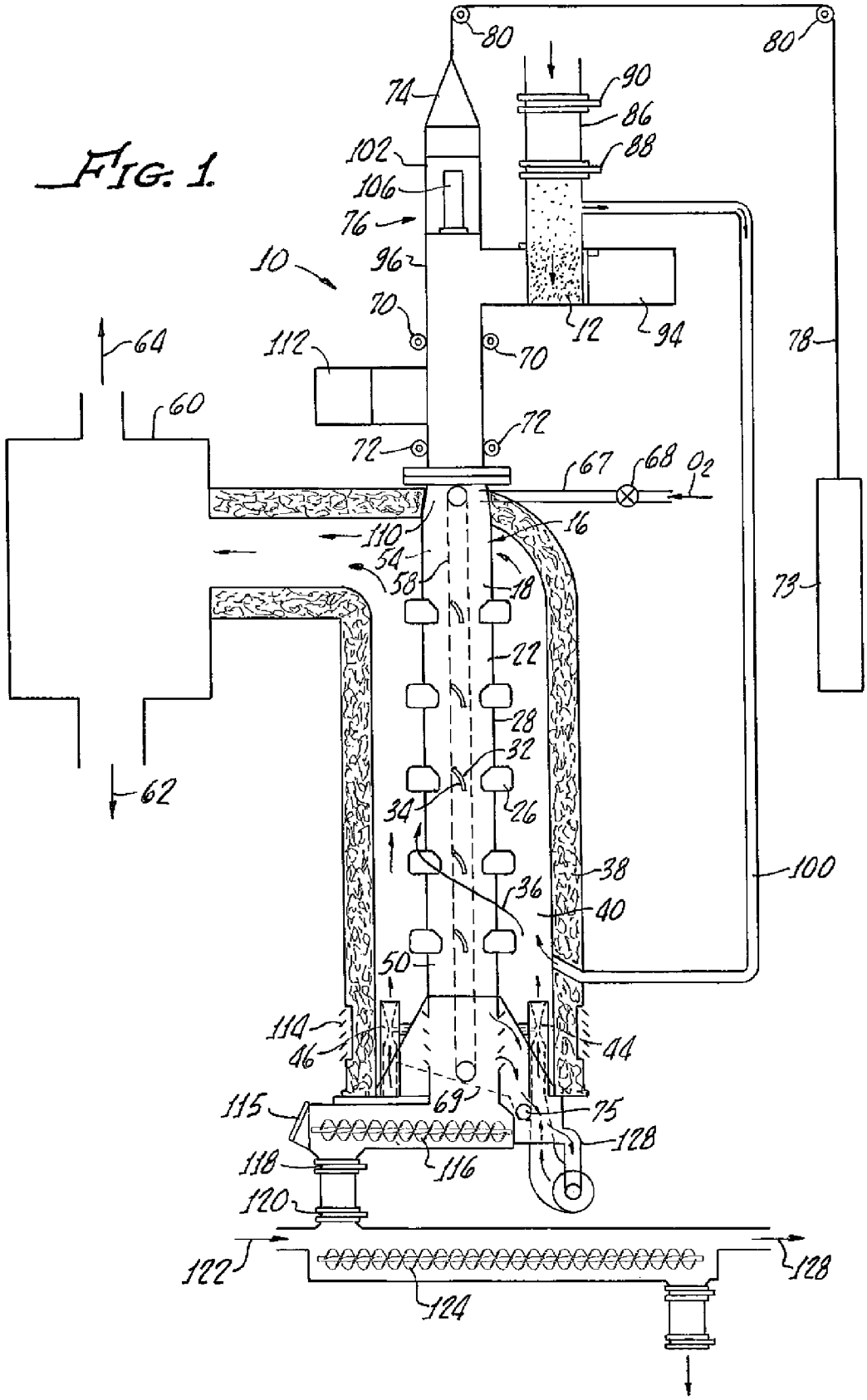
FIG. 1 is a representation of apparatus for the pyrolysis of solid waste material generally showing a thermal reactor with feed mechanism for introducing the waste material into thermal reactor and auger mechanism for removing char from the thermal reactor along with a heating chamber around the thermal reactor in communication with a steam boiler.

With reference to FIG. 1, there is shown apparatus 10 for the pyrolysis of solid waste material 12 which includes a thermal reactor 16 which includes elongate hollow housing 18 which defines a reaction chamber 22. As illustrated, the thermal reactor 16 is oriented in a manner, preferably vertically, in order to cause the solid waste material 12 fed thereinto to pass through the reaction chamber 22 by the force of gravity. Feeding of the waste material 12 into the thermal reactor 16 will be described hereinafter in greater detail.

A plurality of vanes 26 disposed transverse to the housing 18 and extend both exterior and interior to a housing wall 28 for both conducting heat into the reaction chamber 22 and for tumbling the waste material 12 as the waste material 12 passes through the reaction chamber 22. It should be appreciated that the materials of constriction of the apparatus 10 are of a conventional nature typical to the material utilized in conventional pyrolysis apparatus.

The vanes 8 preferably have an arcuate shape and are oriented with a convex surface 32 for contacting passing waste material 12 as it drops through the reaction chamber 22 and a concave surface 34, opposite the convex surface 32, for introducing voids into passing waste material 12. The structure of the present invention therefore eliminates the need for feed augers and the like utilized in conventional pyrolysis apparatus (not shown).

A shell 38 surrounds the thermal reactor 16 to provide a heating chamber 40 around the thermal reactor 16. Burners 44, 46 disposed adjacent a bottom end 50 of the thermal reactor 16. The burners 44, 46 may utilize in part sin gas cycled from a top end 54 of the thermal reactor via a sin glass plenum 58. The heating chamber 40 is also in communication with a steam boiler which provides steam to an autoclave (not shown) as indicated by arrow 62 and spent exhaust gas provided to a drying autoclave (not shown) as indicated by arrow 64.

The vanes 26, exterior to the housing wall 28 further function to produce a helical pattern or swirl, indicated by the arrow 66, to heating gases from the burners 44, 46. This action enhances heat transfer to the reaction chamber 22 through the vanes 26 and housing wall 28.

An inlet 67 including a valve 68 provides a means for introducing oxygen into the sin gas feed to the burners 44, 46. The valve enables control of introduced oxygen which in turn enables control over processing speed. Thus, residence time of the waste material 12 in the reaction chamber 22 is controlled to regulation residual BTVs in the char for post processing.

Fly ash, may be collected by a sloped plate 69 and removed from the reaction chamber 22 by an auger 75.

A support 71 is provided within the heating chamber 40 for the thermal reactor 16 and expansion guide rollers 72 prevent buckling of the reaction chamber during a heating thereof. A counterweight 73 attached to a top 74 of a feed mechanism via a cable 78 and pulleys 80, 82 provides support for the apparatus 10.

The feed mechanism 76 provides a means for introducing the solid waste material 12 into the top end 54 of the thermal reactor 16. More particularly, the feed mechanism 76 includes a vertically oriented rectangular solid waste receiving duct 86 which includes a pair of air valves 88, 90 to isolate the feed mechanisms 56 and thermal reactor 16 from the atmosphere.

Figure 2:
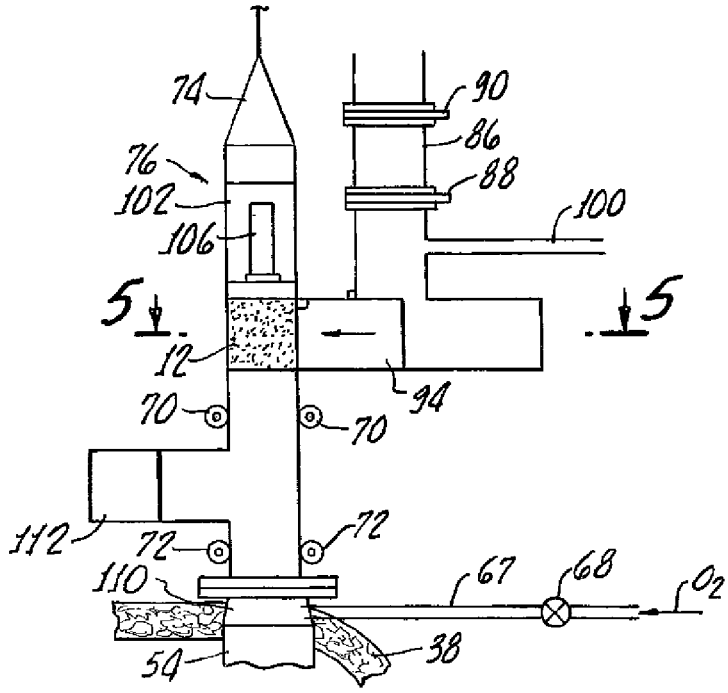
FIGS. 2-4 illustrate operation of the feed mechanism which includes a waste receiving duct, a gathering ram, an input duct with a packer ram, and a pinch ram.

As illustrated in FIG. 2, the gathering ram transversely moves discrete quantities of waste material 12 from the receiving duct 86 into a rectangular input duct 96. Compression of the waste by a gathering ram causes expulsion of air which is supplied to the heating chamber 40 by means of a conduit 100.

Figure 3:
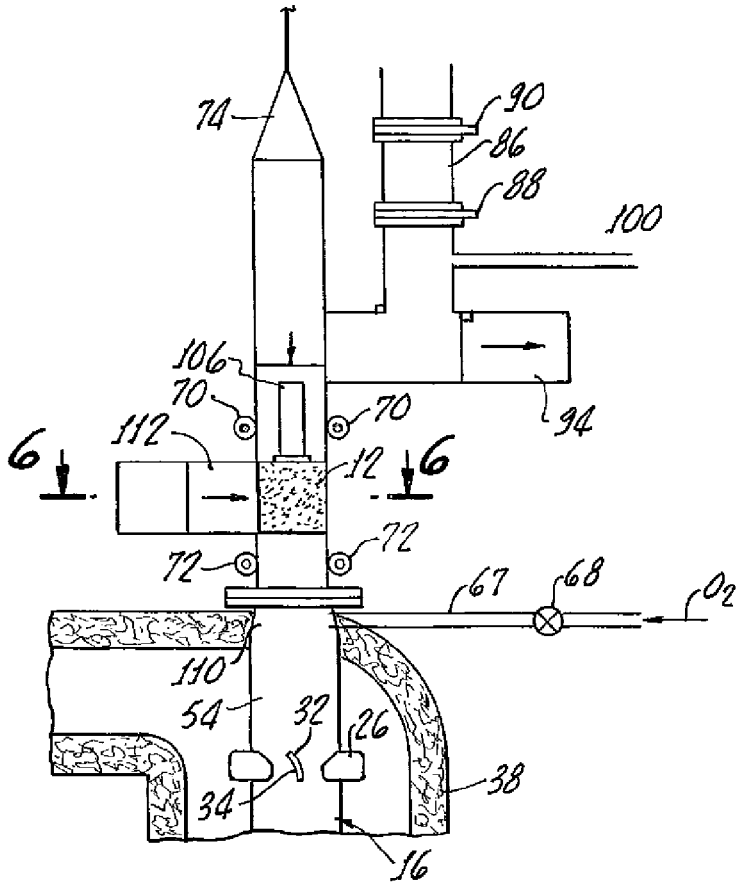

After the solid waste 12 is positioned within the input duct 96 as shown in FIG. 2, a packer ram 102 is utilized to move the solid waste material 12 toward the thermal reactor top 54, as illustrated in FIG. 3.

A piston ram 106 may be provided utilized to further assist in introducing the solid waste material 12 into the reactor top 54. The thermal reactor itself has a circular cross section and solid waste enters through square to round transition section 110.

After positioning of the solid waste proximate the reactor top end 54, a pinch ram 112 is utilized to compress the solid waste to facilitate entry into the thermal reactor 16 via the transition section 110.

Figure 4:
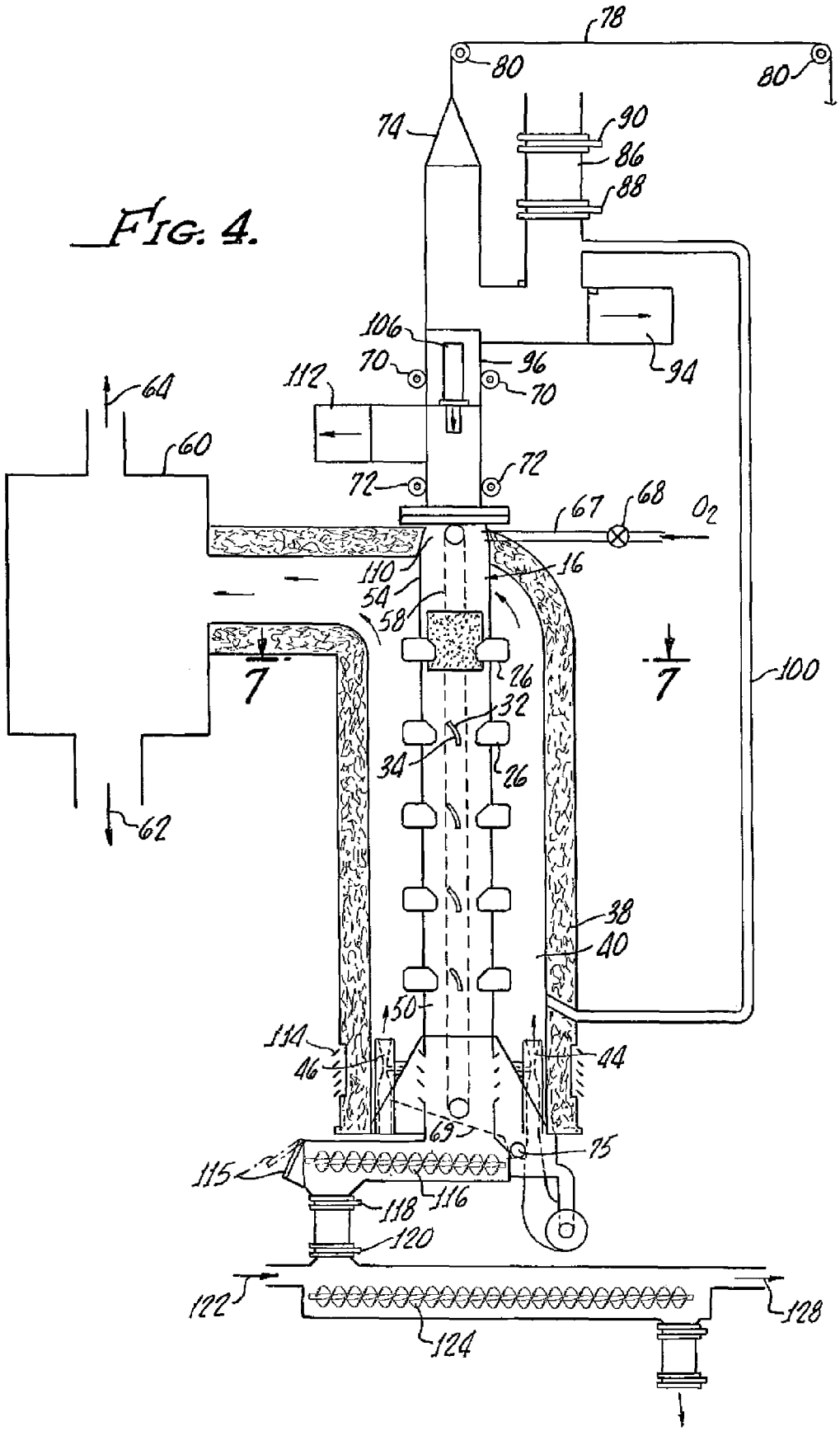

As illustrated in FIG. 4 and hereinabove noted, the piston ram 106 has a smaller diameter than the inside dimensions of the input duct 96. The smaller dimensions of the piston ram prevent expansion of the solid waste as it is force into the thermal reactor 60 where it thereafter passes therethrough by the force of gravity, agitation and mixing of the solid waste being provided by the vanes 26 as hereinabove noted, FIG. 5 illustrates operation of the gathering ram 84 and FIG. 6 illustrates operation of the pinch ram 112. FIG. 7 is a cross section taken along the line 7-7 of FIG. 4 illustrating the thermal reactor 16, housing 18, housing wall 28, vanes 26, and heating chamber 40.

With further reference to FIG. 1, the apparatus 10 in accordance with the present invention further may include an oxidizer blow off 114 and a retort blow off 115 which is adjacent a retort bottom char auger 116 for removing char from the thermal reactor 16 which is further transported through airlock valves 118, 120 and exposed to moist gas from an autoclave (not shown), indicated by the arrow 122, by an auger 124 which expels char from the apparatus 10 as indicated by the arrow 126. Gas expelled from the auger 124 is used to moisten char and reheat gas. Ambient air and sin gas are introduced to the burners 44, 46 means of an intake 128.

Figure 8:
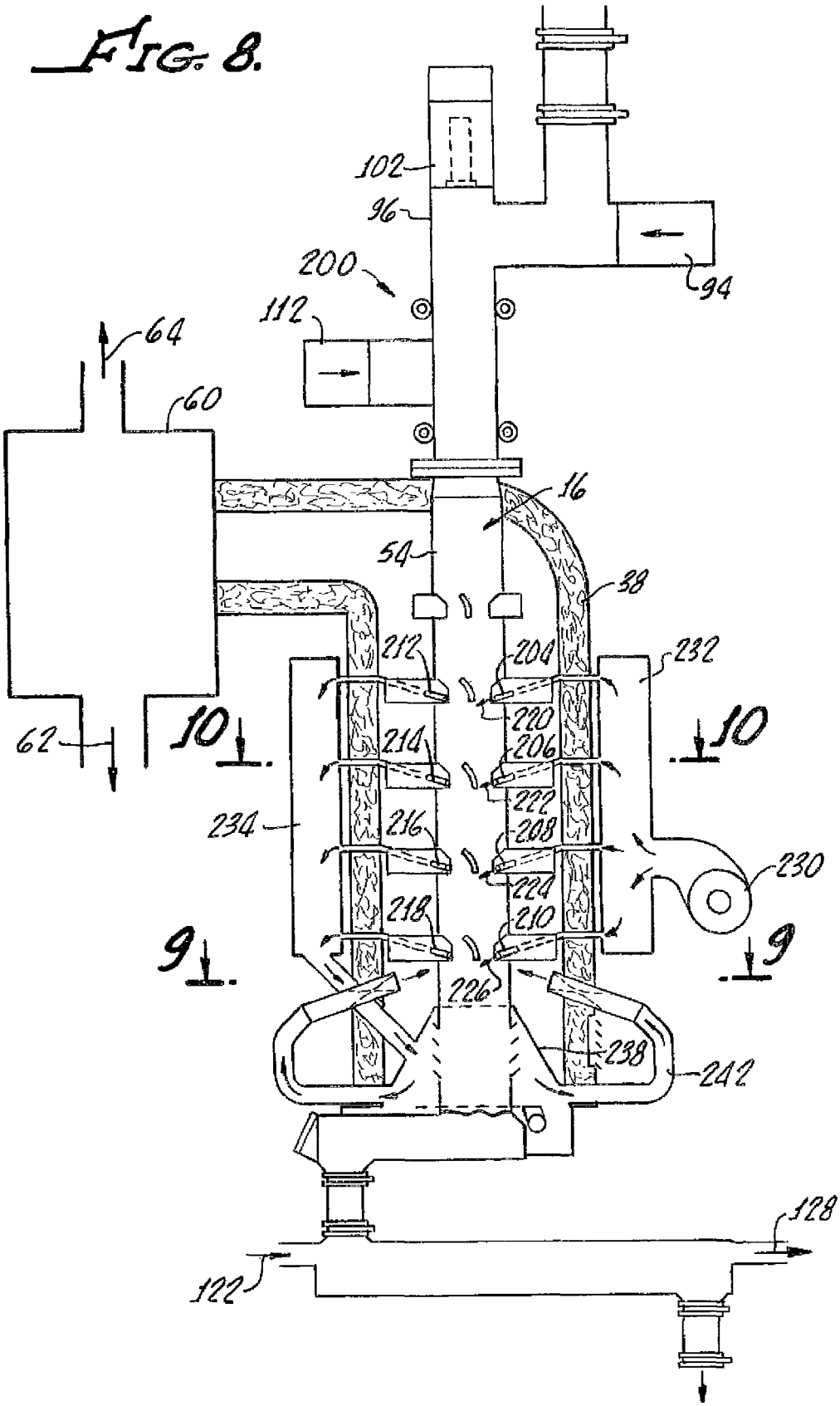
FIG. 8 is a representation of alternate apparatus for the pyrolysis of solid waste material generally showing a thermal reactor with feed mechanism for introducing the waste material into thermal reactor and auger mechanism for removing char form the thermal reactor along with a heating chamber around the thermal reactor in communication with a steam boiler and inlets and outlets for passing oxygen transversely through the reaction chamber.

With reference now to FIG. 8, there is shown apparatus 200 for the pyrolysis of waste material 12. Reference characters in FIG. 8 common with reference characters in FIGS. 1-7 represent identical or substantially similar components as described in connection with the apparatus 10 shown in FIGS. 1-7. Further, the description of these components is not repeated for the sake of brevity. Distinguishing features of the apparatus 20 are hereinafter described as follows:

As shown, a plurality of inlets 204, 206, 208, 210 and a plurality of outlets and a plurality of outlets 212, 214, 216, 218 are provided for passing oxygen transversely through the reaction chamber 22 as indicated by arrows 220, 222, 224, 226.

Figure 9:
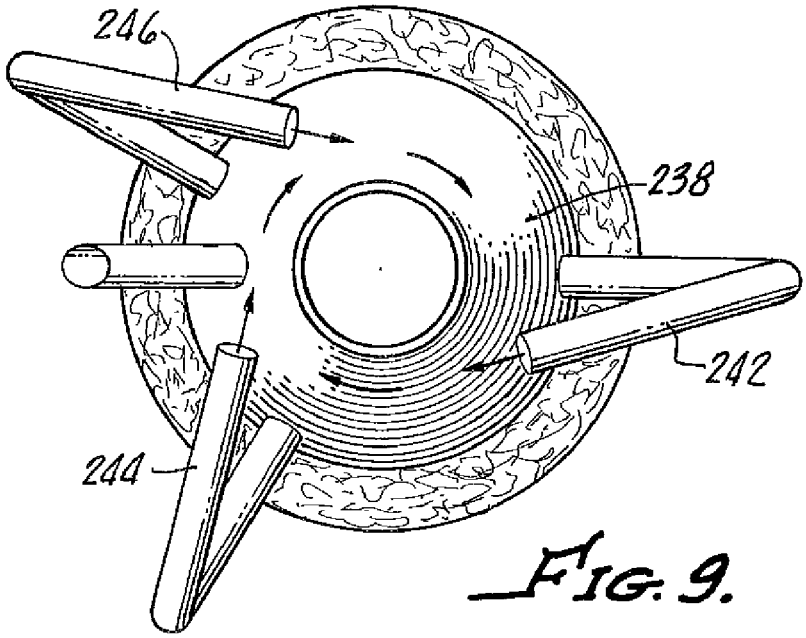
FIG. 9 is a cross-sectional view taken along the line 9-9 of FIG. 8.

The inlets 204-210 are connected to an air intake 230 through an intake manifold 232 which provides air, or oxygen, and the outlets 214-218 are connected to an air intake 236 via a manifold 234 and plenum 238 which, in turn, is then fed to burners 242, 244, 246, see also FIG. 9. The burners 242, 244, 246 are oriented to provide a flame generate tangential to the shell 38 to provide a circulation, or eddy, for more efficient transfer of heat.

Figure 10:
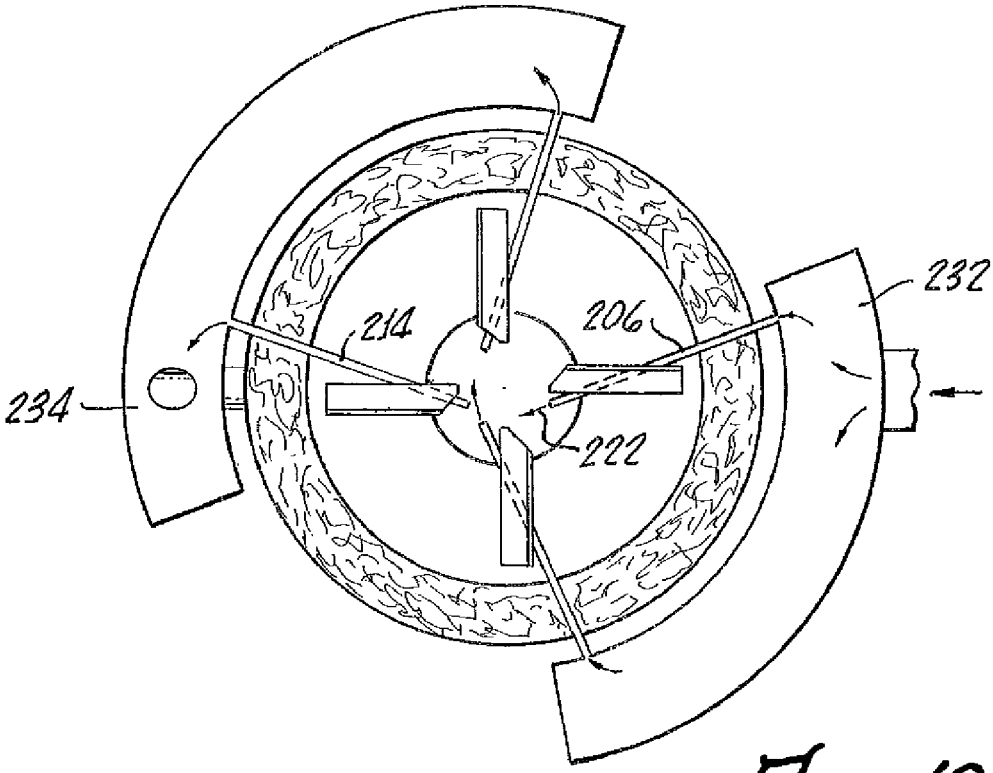
FIG. 10 is a cross-sectional view taken along the line 10-10 of FIG. 8.

As shown in FIG. 10, and best shown in FIG. 8, the inlets 204-210 and outlets 212-218 are fixed to the vanes 26 and are open to the reaction chamber 22 adjacent convex surfaces 32 of the vanes 26 which create voids (not shown) into passing waste material.

Although there has been hereinabove described specific pyrolysis apparatus in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. Apparatus for the pyrolysis of solid waste material, said apparatus comprising:

a vertically oriented thermal reactor including an elongate hollow housing with a reaction chamber disposed within the housing;

a plurality of spaced apart vanes disposed transverse to the housing and extending both exterior and interior to a housing wall for both conducting heat into said reaction chamber and for tumbling solid waste material, introduced into a top of said thermal reactor, as the waste material passes through said reaction chamber;

a heater for supplying heat into the reaction chamber via the heat conducting vanes; and a plurality of spaced apart inlets and outlet for passing oxygen transversely through said reaction chamber, each one of the plurality of inlets and outlets being fixed to a corresponding vane.

2. The apparatus according to claim 1 wherein the vanes have an arcuate shape and are orientated with a convex surface for contacting passing waste material and a concave surface, opposite said convex surface, for introducing voids into the passing waste material.

3. The apparatus according to claim 2 wherein the inlets and outlets are open to the reaction chamber adjacent the convex surfaces of the vanes.

4. The apparatus according to claim 1 further comprising a shell surrounding said thermal reactor to provide a heating chamber around said thermal reactor with burners disposed adjacent a bottom of said thermal reactor.

5. Apparatus for the pyrolysis of solid waste material, said apparatus comprising:

a vertically oriented thermal reactor including an elongate hollow housing with a reaction chamber disposed within the housing;

a plurality of spaced apart inlets and outlets reaction chamber;

a shell surrounding said thermal reaction to provide a heating chamber around said thermal reaction with burners disposed adjacent a bottom of said thermal reactor;

a plurality of spaced apart vanes disposed transverse to the housing and extending both exterior and interior to a housing wall for both conducting heat into said reaction chamber and for tumbling solid waste material, introduced into a top of said thermal reactor, as the waste material passes through said reaction chamber; and wherein each one of the plurality of inlets and outlets are fixed to a corresponding vane.

6. The apparatus according to claim 5 wherein the vanes have an arcuate shape and are orientated with a convex surface for contacting passing waste material and a concave surface, opposite said convex surface, for introducing voids into the passing waste material.

7. The apparatus according to claim 6 wherein the inlet and outlet are open to the reaction chamber adjacent the convex surface of the vanes.

8. The apparatus according to claim 4 wherein said burners are oriented to provide a flame generally tangential to said shell in order to provide an eddy within said shell.

9. The apparatus according to claim 8 further comprising three burners.

* * * * *